US005474477A

United States Patent [19]

Aoyama

[11] Patent Number: 5,474,477

[45] Date of Patent: Dec. 12, 1995

[54] METHOD AND APPARATUS FOR DOUBLY SECURING A TERMINAL WITHIN A CONNECTOR

[75] Inventor: Masahiko Aoyama, Yokkaichi, Japan

[73] Assignee: Sumitomo Wiring Systems, Ltd., Mie, Japan

[21] Appl. No.: 301,645

[22] Filed: Sep. 7, 1994

[30] Foreign Application Priority Data

Sep. 20, 1993 [JP] Japan ..... 5-257652

[51] Int. Cl.[6] ..... H01R 13/436

[52] U.S. Cl. ..... 439/752

[58] Field of Search ..... 439/595, 752

[56] References Cited

U.S. PATENT DOCUMENTS

| | | | |
|---|---|---|---|
| 4,946,399 | 8/1990 | Kawashima | 439/752 |
| 5,066,252 | 11/1991 | Kato et al. | 439/752 |
| 5,203,722 | 4/1993 | Kinoshita | 439/752 |
| 5,252,096 | 10/1993 | Okada | 439/752 |
| 5,299,958 | 4/1994 | Ohsumi | 439/752 |

*Primary Examiner*—Gary F. Paumen
*Attorney, Agent, or Firm*—Oliff & Berridge

[57] ABSTRACT

A connector includes a retainer for retaining metal terminals within a housing. The retainer includes provisional retaining projections and complete retaining projections. The retainer can be held on a housing in three depth positions. Namely, in the first insertion position (free position) of the retainer, the metal terminal is allowed to be inserted and withdrawn. In the second insertion position (provisional retained position), the provisional retaining portion engages the stabilizers to prevent the withdrawal of the metal terminal but allows the insertion of the metal terminal. In the third insertion position (complete retained position), the complete retaining projection is projected into and engaged in a retaining hole in the metal terminal, thereby preventing the withdrawal and insertion of the metal terminal.

18 Claims, 4 Drawing Sheets

METHOD AND APPARATUS FOR DOUBLY SECURING A TERMINAL WITHIN A CONNECTOR

BACKGROUND OF THE INVENTION

This invention relates to a connector of the type in which double retaining is effected by a retainer.

Many conventional connectors adopt a so-called double retaining construction for positively preventing withdrawal of a metal terminal. In such a construction, as shown in FIG. 5, an elastic piece 32 (called a lance) is formed within a terminal receiving hole 31 formed in a connector housing 30 (hereinafter "housing"). A metal terminal 33 is resiliently retained by the lance (in a provisional retaining condition shown in solid lines in FIG. 5), and a retainer 34 is fitted in the housing 30 to be engaged with a jaw 35 of the metal terminal 33 (in a complete retaining condition shown in phantom in FIG. 5). Thus, the metal terminal 33 is retained against withdrawal by two retainers.

However, several problems are encountered in the above conventional construction, because the lance 32 is formed within the terminal receiving hole 31. Because the lance 32 is of a complicated shape and formed in the narrow terminal receiving hole 31, the construction of the housing, as well as the construction of a mold, inevitably becomes complicated. Further, the internal space of the terminal receiving hole 31 must be enough to accommodate the lance 32 and also to allow the flexing of the lance 32, and accordingly the housing 30 is increased in size.

For withdrawing the metal terminal 33, the retainer 34 is first removed from the housing 30, and then the lance 32 is disengaged. In this case, a special tool is inserted into the terminal receiving hole 31 from its open front end, and the lance is forcibly flexed and deformed by the tool. At this time, in some cases, the lance may be damaged so that it can not be used again, and also the metal terminal 33 may be damaged by the tool impinging on the metal terminal.

Further, in the conventional construction, provisional retaining iS effected by the lance 32 whereas complete retaining is effected by the retainer 34. Thus, the different kinds of retainers effect their respective withdrawal prevention operations at different positions in the direction of the length of the metal terminal 33. Therefore, unless the two positions are accurately determined, proper assembling cannot be carried out. Therefore, in such a conventional construction, the tolerance of the respective dimensions is required to be extremely high, thus resulting in prohibitively high manufacturing costs.

SUMMARY OF THE INVENTION

The present invention has been made in view of the above problems, and an object of the invention is to provide a connector of the type that is simple in construction, and facilitates the withdrawal of a metal terminal.

In a first aspect of the invention, there is provided a connector having a housing having terminal receiving holes for receiving metal terminals and a retainer insertion hole that is formed across the terminal receiving holes and extends from a side of the housing. The connector also includes a retainer insertable into the retainer insertion hole, the retainer having provisional retaining portions each capable of provisionally retaining an associated metal terminal in such a manner as to allow the insertion of the metal terminals in a primary inserted position of the retainer, and the retainer having complete retaining portions each capable of completely retaining the associated metal terminal against withdrawal in a secondary inserted position of the retainer that is deeper than the primary inserted position. The connector housing may include retaining portions that are arranged in a direction of insertion of the retainer, the retaining portions releaseably holding the retainer. The retaining portions are disposed respectively at a first insertion depth position so as to freely allow the insertion and withdrawal of the metal terminals, to allow insertion but not withdraw at a second depth, and to allow complete retaining of the metal terminal without allowing either insertion or withdrawal at a third depth.

In a second aspect of the invention, there is provided a method for assembling terminals within terminal receiving holes in housing. The method comprises the steps of forming the housing with a recess and inserting a retainer partially in said recess, inserting the terminals through the terminal receiving holes until stabilizers of the terminals align with the retainer, engaging the stabilizers with a provisional retaining portion of said retainer whereby said terminals can be inserted but not withdrawn, and fully inserting the retainer in the recess thereby engaging complete retainer portions of the retainer with retaining holes formed in the terminal while maintaining engagement between the provisional retaining portion and the stabilizers.

In yet another aspect of the present invention, there is provided a connector for selectively and fixedly securing a terminal within a housing. The connector housing includes terminal receiving holes for receiving terminals, the terminal receiving holes being formed on end portions of the housing and on a retainer located in a retainer insertion hole between the end portions, the retainer including means for attaching the retainer to the housing and means for selectively and independently engaging two portions of the terminal with the retainer.

The metal terminals are attached in the following manner. Namely, the retainer is lightly inserted into the retainer insertion hole, and then the metal terminal connected to a wire is inserted into the associated terminal receiving hole in the housing. In this case, the provisional retaining portion of the retainer first provisionally retains the associated metal terminal in the primary insertion depth position, thereby achieving a provisional withdrawal. However, in this condition, the other terminals can be still inserted, and therefore there is no need to withdraw the retainer. When the retainer is further inserted from the primary insertion depth position into the secondary insertion depth position, the complete retaining portion completely retains the metal terminal, thereby completely preventing the withdrawal of the metal terminal. The retainer can be held on the housing in any one of at least two, but preferably three different insertion depth positions.

With this structure, there is no need for a lance in the terminal receiving hole, and therefore the internal structure of the terminal receiving hole is made simpler, and also the housing can be of a smaller size. Furthermore, the double retaining can be effected by the single member, that iS, the retainer, and therefore control is only required with respect to the single position where the retainer is inserted, thus allowing for greater manufacturing tolerances. The use of the lance is omitted, and the retainer can be held at a position where the metal terminal can be withdrawn. Therefore, the operation can be smoothly carried out without damaging the lance and the metal terminal.

BRIEF DESCRIPTION OF THE DRAWINGS

The invention will be disclosed in detail with reference to the following drawings wherein.

DETAILED DESCRIPTION OF PREFERRED EMBODIMENTS

Figure 1:
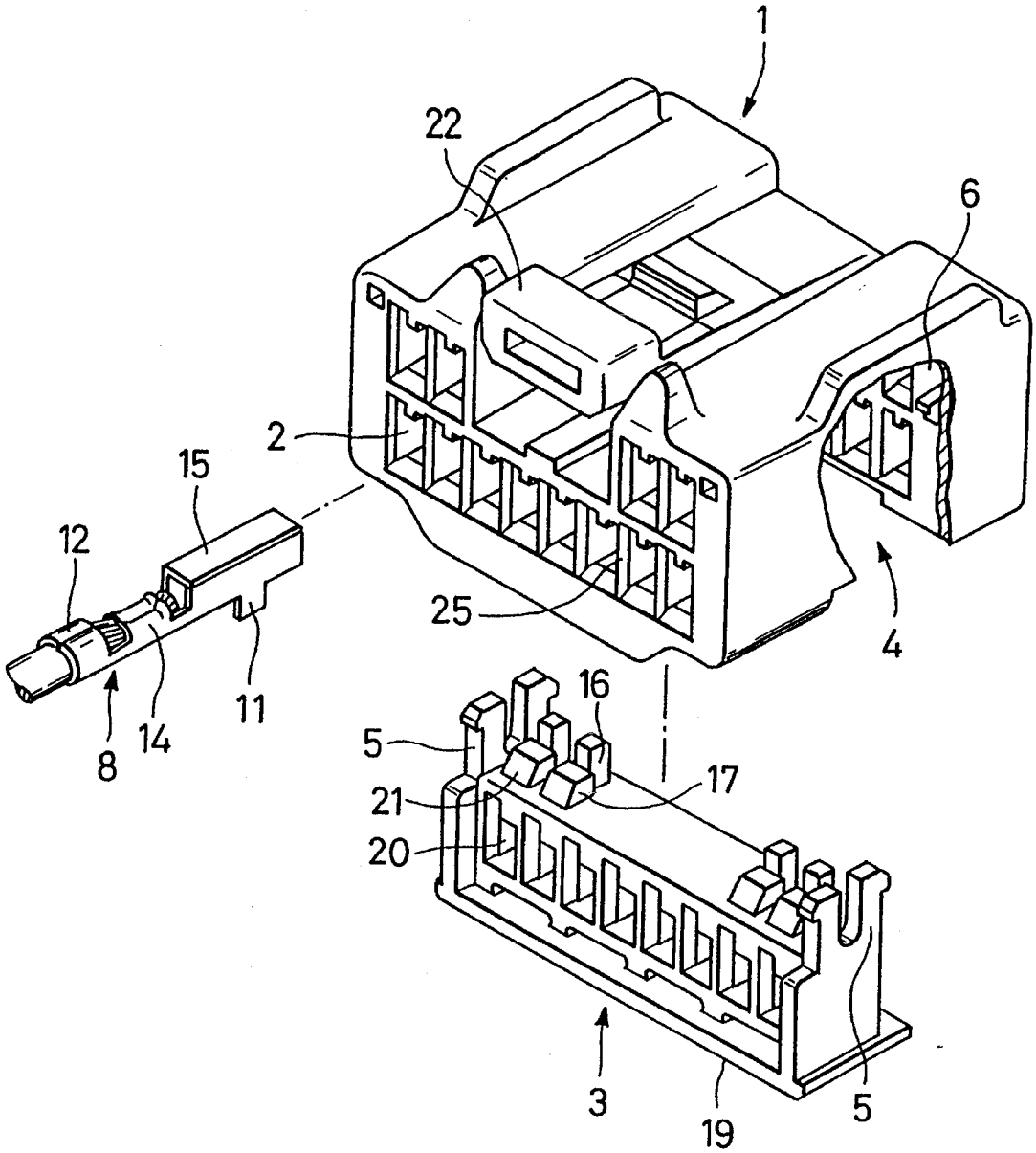
FIG. 1 is an exploded, perspective view of a connector of the present invention.

A preferred embodiment of the present invention will now be described in detail with reference to the drawings. In FIG. 1, a housing 1 can be fitted relative to its mating housing and wires each having a metal terminal 8 connected to its front end, as well as a retainer 3 for engaging the metal terminals 8 against withdrawal, are adapted to be attached to the housing 1.

Formed on an upper surface (FIG. 1) of the housing 1 is a retaining arm 22 that engages the mating housing (not shown) against withdrawal when the two housings are fitted together. The interior of the housing 1 is divided by partition walls 25, arranged in a lattice manner, into a plurality of terminal receiving holes 2 extending in a direction of the length of the housing. A retainer insertion hole 4 for receiving the retainer 3 is formed in a lower surface of the housing 1, the hole 4 being open generally over an entire width of the housing 1. The hole 4 extends in a direction of the height of the housing in such a manner that the hole 4 divides all of the terminal receiving holes 2 into front and rear portions.

Figure 2A:
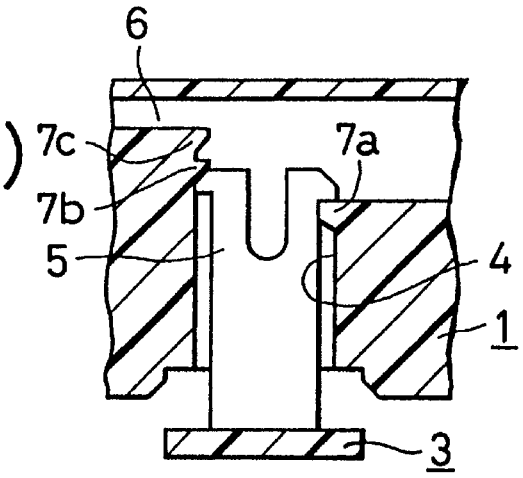
FIGS. 2(*a*)–(*c*) are enlarged, cross-sectional views of the end portion of the connector showing the sequence of engagement of a retaining leg portion.
Figure 2B:
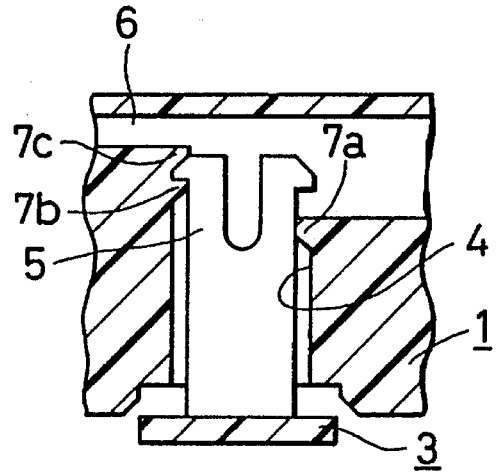
Figure 2C:
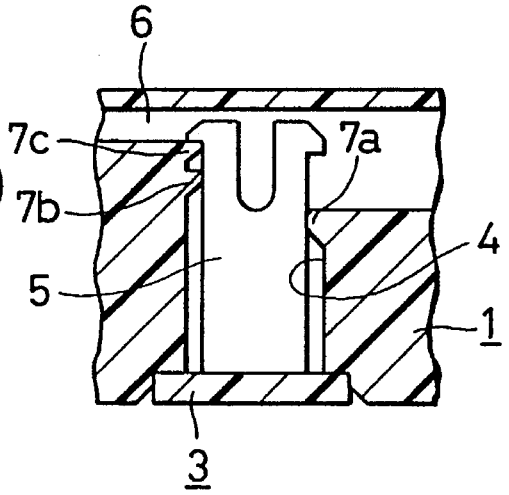

As shown in FIGS. 2(*a*)–(*c*), opposite ends of the retainer insertion hole 4 at its deepest portion are in communication respectively with engagement grooves 6 for receiving retaining leg portions 5 (described later) of the retainer 3. Although not shown in detail, the two engagement grooves 6 are disposed outwardly of the terminal receiving holes 2, and are formed through the housing and extend in the direction of the length of the housing 1. As shown in FIGS. 2(*a*)–(*c*), three retaining projections (retaining portions) 7*a* to 7*c* are formed on opposed front and rear walls of the retainer insertion hole 4, and are disposted adjacent to each of the two engagement grooves 6, the three retaining projections 7*a* to 7*c* being disposed at different depths, respectively. In this embodiment, one of the retaining projections is formed on one of the hole walls at the shallowest insertion position, and the other two retaining projections are formed on the other hole wall, and are disposed at adjoining deeper positions, respectively. The retaining leg portion 5 can releaseably engage these retaining projections. As will be more fully described hereafter, an engagement position shown in FIG. 2(*a*) is a free position where the insertion and withdrawal of the metal terminals 8 are allowed, an engagement position of FIG. 2(*b*) is a provisional retaining position where the insertion of the metal terminals 8 is allowed, but the withdrawal thereof is prevented, and an engagement position of FIG. 2(*c*) is a complete retaining position where the insertion and withdrawal of the metal terminals 8 are prevented.

Figure 3A:
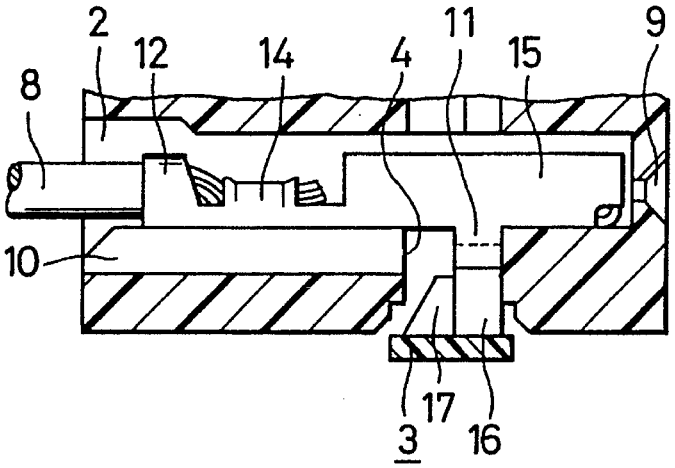
FIG. 3(*a*)–(*c*) are enlarged, cross-sectional views of the central portion of the connector showing the sequence of engagement of a metal terminal.
Figure 3B:
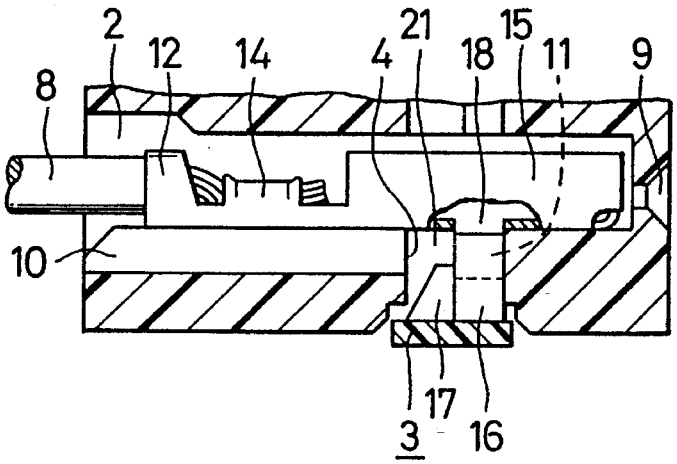
Figure 3C:
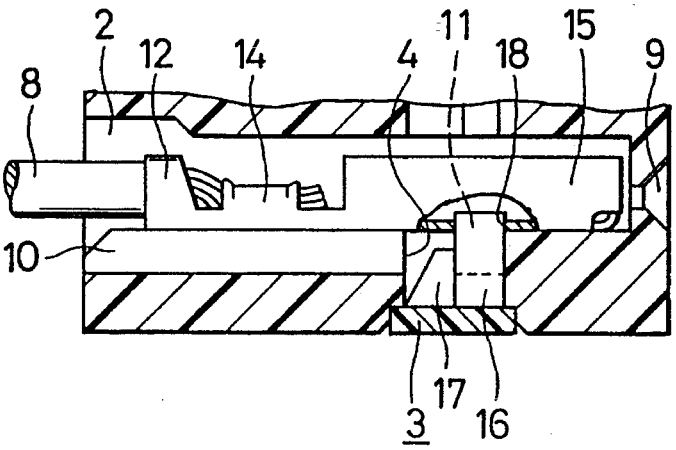

As shown in FIGS. 3(*a*)–(*c*), each of the terminal receiving holes 2 accommodates an inserted metal terminal 8 and is open at its front end to provide an insertion window 9 for receiving a metal terminal in the mating housing. A guide ridge is formed on a bottom surface of each terminal receiving hole 2. The guide ridge 10 can be sandwiched between a pair of stabilizers 11 of the metal terminal 8, and with this arrangement the insertion of the metal terminal 8 is guided.

The metal terminal 8 will now be described with reference to FIGS. 3(*a*)–(*c*). The metal terminal 8 has at its rear end an insulation barrel 12 to which a front end of a covering of the wire is fixedly secured by compressive clamping, and also has a wire barrel 14 disposed forwardly of the insulation barrel 12, a conductor of the wire being fixedly secured to the wire barrel 14 by compressive clamping. Further, the metal terminal has a tubular connection portion 15 of a square cross-section disposed forwardly of the wire barrel 14, the male metal terminal (not shown) being adapted to be inserted into the tubular connection portion 15. The pair of stabilizers 11 are formed by stamping on a lower surface of the tubular connection portion 15, and are opposed to each other in a direction of the width of the metal terminal. With this construction, an opening is formed in the lower surface (FIGS. 3(*a*)–(*c*)) of the tubular connection portion 15, and the opening defines a retaining hole 18 for receiving a completely retaining projection 16.

The retainer 3 has a frame-like shape, and can fit in the retainer insertion hole 4 in the housing 1, and one face of the retainer serves as a manipulation surface 19 for press-fitting purposes. The retainer 3 is partitioned to provide terminal receiving holes 20 that are registrable respectively with the terminal receiving holes 2 in the housing 1. The pair of retaining leg portions 5 are formed upright respectively on opposite end portions of the retainer 3 in opposed relation to each other. The two retaining leg portions 5 are projected in the direction of insertion of the retainer into the housing 1, and each of these leg portions 5 is bifurcated so as to be elastically deformed in a leg closing direction. As described above, each retaining leg portion is selectively engaged with the associated retaining projections 7*a* to 7*c* so that the retainer 3 can be held on the housing 1 in the three insertion-depth positions.

As shown in FIG. 1, two pairs of provisional retaining and complete retaining projections 17 and 16 are formed on the upper surface (which faces the housing 1) of the retainer 3 at each of its opposite end portions. Thus, the four pairs of retaining projections are formed on the retainer, and are registrable respectively with the upper terminal receiving holes 2 in the housing 1. Similarly, a pair of such provisional retaining and complete retaining projections 17 and 16 is provided in each of the terminal receiving holes 20 in the retainer 3, and is registrable with a respective one of the lower terminal receiving holes 2 in the housing 1.

The provisional retaining projection 17 is disposed forwardly in the direction of insertion of the metal terminal 8, and the complete retaining projection 16 is disposed rearwardly of the provisional retaining projection in contiguous relation thereto. The provisional retaining projection 17 is greater in width than the complete retaining projection 16, and is wider than the distance between the two stabilizers 11 of the metal terminal 8. Therefore, the two stabilizers 11 are engaged with a rear surface of the provisional retaining projection 17, and also are disposed respectively on the opposite sides of the complete retaining projection 16, thereby holding the metal terminal 8 against withdrawal. Further, a front surface of the provisional retaining projection 17 is slantingly upwardly in the direction of insertion of the metal terminal 8 to provide a slanting surface 21 that can guide the sliding of the stabilizers 11 over the provisional retaining projection. Namely, in the provisional retained condition shown in FIG. 3(*b*), the stabilizers 11 of the inserted metal terminal 8 are engaged with the provisional retaining projection 17, thereby holding the metal terminal against withdrawal. In this condition, even if another metal terminal 8 is inserted into the associated terminal receiving hole 2, the stabilizers 11 can slide over the provisional retaining projection, thus allowing the insertion of the metal terminal 8. The internal space of the terminal receiving hole 2 has a sufficient height to allow the sliding movement.

The complete retaining projection 16 has such a width as to allow the stabilizers 11 to pass past it, and is greater in height than the provisional retaining projection 17. The complete retaining projection 16 has such dimensions that its tip is disposed slightly short of the retaining hole 18 in the provisionally retained condition (FIG. 3(*b*)), but is received and engaged in the retaining hole 18 in the complete retained condition (FIG. 3(*c*)).

The operation and effect of this embodiment of the above construction will now be described. The retainer 3 is lightly or partially inserted into the retainer insertion hole 4 in the housing 1. As a result, each retaining leg portion 5 of the retainer 3 engages the retaining projection 7*a* disposed at the shallowest position, so that the whole of the retainer 3 is first held at the free position shown in FIG. 2(*a*). In this position, the distal end of each of the complete retaining projections 16 is slightly projected into the associated terminal receiving hole 2, but each of the provisional retaining projections 17 is disposed in a position retracted from the terminal receiving hole 2, as shown in FIG. 3(*a*). In this condition, the metal terminal 8 is inserted into the terminal receiving hole 2, with the stabilizers 11 disposed respectively on the opposite sides of the guide ridge 10, and the metal terminal 8 reaches the normal insertion position disposed immediately adjacent to the insertion window 9. At this time, the stabilizers 11 can pass above the provisional retaining projection 17, and also can receive the distal end portion of the complete retaining projection 16 therebetween, and therefore the metal terminal 8 is withdrawably inserted.

After the wires, each having the metal terminal 8, are thus inserted into the required terminal receiving holes 2, respectively, the retainer 3 is further inserted, so that each retaining leg portion 5 engages the retaining projection 7*b* disposed at the second deepest position, as shown in FIG. 2(*b*), thereby holding the retainer 3 in the provisional retained position. Namely, at this time, the distal end of the complete retaining projection 16 has not yet been engaged in the retaining hole 18, but is disposed immediately adjacent to the retaining hole, as shown in FIG. 3(*b*). The provisional retaining projection 17 is projected slightly into the terminal receiving hole 2, and is slightly engaged with the stabilizers 11, so that the metal terminal 8 is provisionally retained against withdrawal.

In some cases, all of the metal terminals 8 are simultaneously inserted respectively into the associated terminal receiving holes 2; however, depending on the operation procedure, same of the metal terminals may be inserted after the above provisionally retained condition is achieved. In such a case, when another metal terminal 8 is inserted into the associated terminal receiving hole 2 while provisionally retaining the already-inserted metal terminal 8, the stabilizers 11 slide over the slanting surface 21 of the provisional retaining projection 17, and engage with the projection 17, thereby similarly achieving the provisionally retained condition.

When the retainer 3 is further inserted from the provisionally retained position, each retaining leg portion 5 engages the retaining projection 7*c* disposed at the deepest position, as shown in FIG. 2(*c*), so that the retainer 3 is held in the completely retained position. Namely, at this time, the provisional retaining projection 17 is more deeply engaged with the stabilizers 11, and also the complete retaining projection 16 is projected into the retaining hole 18, as shown in FIG. 3(*c*), and therefore the metal terminal 8 is held in the completely retained condition, thereby positively preventing the withdrawal of the metal terminal. Thus, the assembling operation relative to a connector is completed.

When it is required to withdraw the metal terminal 8, a suitable tool having a pointed tip is used at a position immediately adjacent to the manipulation surface 19 of the retainer 3, and this tool is manipulated to effect a withdrawing operation, so that each retaining leg portion 5 is forcibly disengaged from the retaining projections 7*b* and 7*c*. Then, the retainer 3 is pulled or retracted from the retainer insertion hole 4, and is returned to the free position of FIG. 2(*a*), so that the metal terminal 8 can be freely withdrawn.

As described above, in this embodiment, the use of conventional lances is omitted, and therefore the internal structure of the housing 1 can be made simpler, and at the same time the structure of a mold for molding purposes can be made simpler. Furthermore, because of the omission of such lances, a space for allowing the flexing of the lance is not necessary, which further contributes to the small-size design of the housing 1. Further, because the withdrawal of the metal terminal 8 is made possible merely by retracting the retainer 3, the metal terminal 8 and the lance will not be damaged during withdrawal, and the operation can be carried out smoothly. Furthermore, because the metal terminal 8 is provisionally and completely retained at the same position, the accuracy requirements of attachment of the retainer 3 to the housing 1 is relaxed, and the management of the manufacture is easier.

Figure 4A:
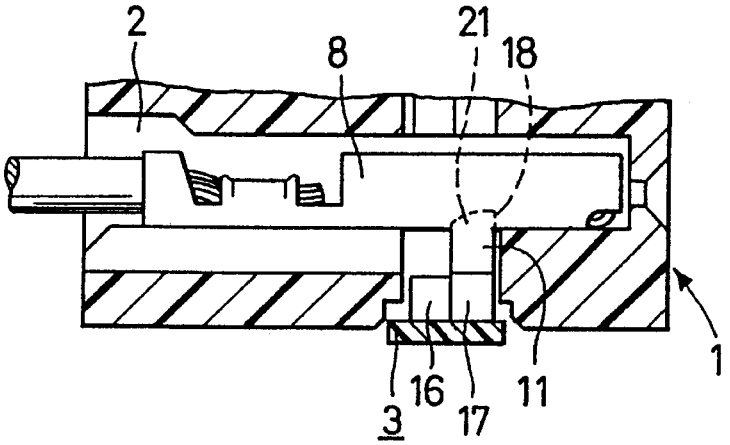
FIGS. 4(*a*)–(*b*) are enlarged, cross-sectional views of a second embodiment of the invention, showing the sequence of engagement of a metal terminal.
Figure 4B:
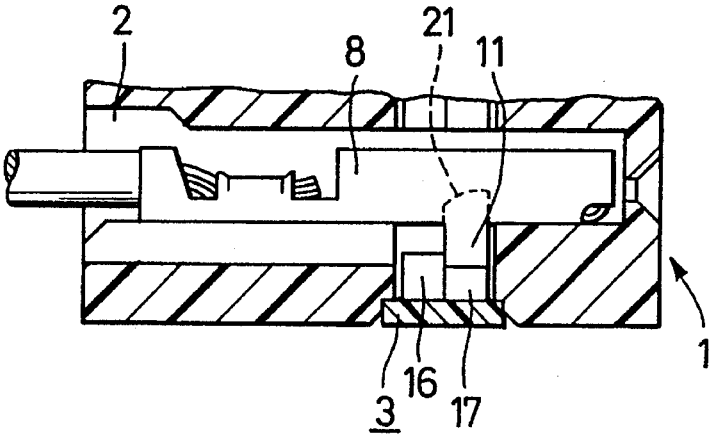
Figure 5:
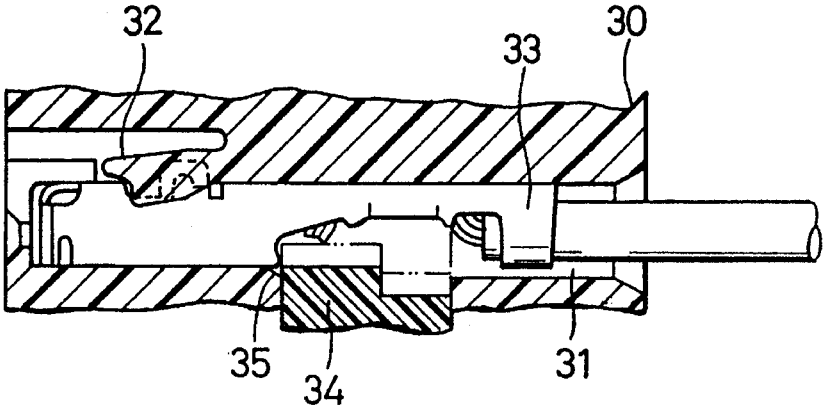
FIG. 5 RELATED ART
FIG. 5 is an enlarged, cross-sectional view showing a condition of engagement of a conventional metal terminal.

FIGS. 4 (*a*) and 4(*b*) show a second embodiment of the present invention. In the second embodiment, a provisional retaining projection 17 and a complete retaining projection 16 are arranged in a manner reverse to that in the first embodiment. More specifically, in a provisionally retained condition of FIG. 4(*a*), the right-hand provisional retaining projection 17 is slightly projected into the retaining hole 18 to be loosely engaged therein, but the left-hand complete retaining projection 16 is not projected into the terminal receiving hole 2, and is not engaged with the stabilizers 11. In this condition, another metal terminal 8 can be inserted due to the provision of a slanting surface 21 on a front side of the provisional retaining projection 17.

When the retainer 3 is inserted deeper, the provisional retaining projection 17 is projected deep into the retaining hole 18, and also the complete retaining projection 16 is engaged with the stabilizers 11, so that the metal terminal 8 is held in the completely retained condition, thereby positively preventing the withdrawal of the metal terminal. The remaining portion of the construction of this embodiment is the same as in the first embodiment, and therefore similar effects can be achieved.

The present invention can be modified in various ways, and the number of the terminal receiving holes, the kind of the metal terminals to be used (several kinds of metal terminals can be used in combination) are not limited. Although the connector for the female metal terminals are shown in the drawings, the invention can, of course, be applied to a connector for male metal terminals. Further, in the two embodiments, although the stabilizers are provided for effecting the provisional retaining and the complete retaining, any other suitable projection may be used.

The invention has been described in detail with reference to preferred embodiments thereof, which are intended to be illustrative but not limiting. Various changes may be made without departing from the spirit and scope of the invention as set forth in the appended claims.

What is claimed is:

1. A connector comprising:

a connector housing having terminal receiving holes for receiving metal terminals, said housing having a retainer insertion hole that is formed transverse to said terminal receiving holes, and extends from a side of said housing; and a retainer insertable into said retainer insertion hole, said retainer having provisional retaining portions each capable of provisionally retaining an already inserted associated metal terminal while simultaneously allowing the insertion of other said metal terminals in a primary inserted position of said retainer, said retainer also having complete retaining portions each capable of completely retaining the associated metal terminal against withdrawal in a secondary inserted position of said retainer that is deeper in said retainer insertion hole than said primary inserted position.

2. The connector according to claim 1, in which retaining portions are formed on said connector housing and are arranged in a direction of insertion of said retainer, said retaining portions releaseably holding the retainer, and said retaining portions being disposed at a first insertion depth position so as to allow the insertion and withdrawal of the metal terminals, at a second insertion depth position so as to allow the provisional retaining of said metal terminals, and at a third insertion depth position so as to allow the complete retaining of said metal terminals.

3. A method for assembling terminals within terminal receiving holes in a housing, each of said terminals including stabilizers and a terminal retaining hole, said method comprising the steps of:

forming the housing with a recess and inserting a retainer partially in said recess;

inserting said terminals through said terminal receiving holes until stabilizers of said terminals align with said retainer;

engaging one of said terminal retaining hole and a pair of said stabilizers with a respective provisional retaining portion of said retainer whereby said terminals can be inserted but not withdrawn; and fully inserting the retainer in the recess thereby engaging a respective complete retaining portion of said retainer with the other of said terminal retaining hole and a pair of said stabilizers while maintaining engagement between the provisional retaining portion and said one of said terminal retaining hole and said pair of stabilizers.

4. The method of claim 3, further comprising the step of providing the retainer with terminal receiving holes and providing each of said retainer terminal receiving holes with second provisional retainer portions and second complete retainer portions.

5. The method of claim 3, further comprising inserting the retainer to a first depth in which the terminals are freely insertable and withdrawable from said terminal receiving holes, inserting the retainer to a second depth to allow insertion of further terminals but preventing removal of terminals already engaged with respective provisional retaining portions, and inserting the retainer to a third depth to prevent terminals from being inserted or withdrawn.

6. The method of claim 5, further comprising providing the housing with a plurality of retaining projections and said retainer with a plurality of corresponding retaining legs, wherein engagement between predetermined ones of said corresponding retaining projections and retaining legs defines said first depth, said second depth, and said third depth.

7. The method of claim 3, wherein said provisional retaining portion engages said pair of stabilizers and said complete retaining portion is inserted into said terminal retaining hole.

8. The method of claim 3, wherein said provisional retaining portion is inserted into said terminal retaining hole and said complete retaining portion engages said pair of stabilizers.

9. A connector for selectively and fixedly securing terminals within a housing, comprising terminal receiving holes for receiving terminals, said terminal receiving holes being formed partially on end portions of said housing and partially on a retainer located in a retainer insertion hole between said end portions, said retainer including means for attaching the retainer to the housing and means for selectively and independently engaging two portions of each said terminal with the retainer wherein said two portions of each said terminal include a first portion comprising a pair of stabilizers and a second portion comprising a retaining hole.

10. The connector of claim 9, wherein said means for selectively engaging two portions includes a provisional retainer that selectively engages one of said retaining hole and said pair of stabilizers and a complete retainer that engages the other of said pair of stabilizers and said retaining hole.

11. The connector of claim 8, wherein said provisional retainer includes a slanting surface for allowing sliding engagement between said provisional retainer and one of said retaining hole and said pair of stabilizers.

12. The connector of claim 9, wherein said pair of stabilizers straddle a guide ridge formed in said terminal insertion hole.

13. The connector of claim 9, wherein said means for attaching the retainer to the housing includes a retaining leg attached to each end of the retainer and retaining projections mounted on said housing, said retaining legs and retaining projections defining at least two positions corresponding to partial and complete retaining positions of the terminals within the terminal receiving holes.

14. The connector of claim 13, wherein the retainer includes a manipulation surface for adjusting the retainer in said partial and said complete retaining positions.

15. The connector of claim 13, wherein said retaining legs engage engagement grooves formed outwardly of selected ones of said terminal receiving holes when the retainer is in the complete retaining position.

16. The connector of claim 9, wherein the housing includes an upper row and a lower row of terminal receiving holes and said retainer includes an intermediate row of terminal receiving holes that align with the lower row.

17. The connector of claim 16, wherein the intermediate row includes a lower provisional retainer and a lower permanent retainer disposed within each intermediate receiving hole.

18. The connector of claim 17, wherein the upper row of terminal receiving holes cooperates with an upper provisional retainer and an upper complete retainer disposed above said intermediate row.

* * * * *